United States Patent [19]

Taguchi

[11] Patent Number: 4,778,414

[45] Date of Patent: Oct. 18, 1988

[54] TRIM ANGLE CONTROL DEVICE FOR MARINE PROPULSION MOTORS

[75] Inventor: Michihiro Taguchi, Hamamatsu, Japan

[73] Assignee: Sanshin Kogyo Kabushiki Kaisha, Hamamatsu, Japan

[21] Appl. No.: 912,364

[22] Filed: Sep. 26, 1986

[30] Foreign Application Priority Data

Oct. 2, 1985 [JP] Japan ..... 60-218121

[51] Int. Cl.[4] ..... B63H 5/12

[52] U.S. Cl. ..... 440/1; 440/61

[58] Field of Search ..... 440/1, 2, 61

[56] References Cited

U.S. PATENT DOCUMENTS 3,834,345 9/1974 Hager et al. ..... 440/1

4,005,674 2/1977 Davis ..... 440/1

4,318,699 3/1982 Wenstadt et al. ..... 440/1

4,605,375 8/1986 Ferguson ..... 440/1

*Primary Examiner*—Joseph F. Peters, Jr.

*Assistant Examiner*—Jesûs D. Sotelo

*Attorney, Agent, or Firm*—Ernest A. Beutler

[57] ABSTRACT

Several embodiments of semi-automatic trim controls for marine outboard drives wherein the operator may achieve trim up or trim down operation at his choice. In accordance with the various embodiments, an arrangement is provided for discontinuing operation of the power means once a preset position is reached. Trim up may be selected automatically upon reaching of a predetermined speed. In one embodiment, speed is sensed by measuring engine speed and in another embodiment, throttle position is sensed.

11 Claims, 3 Drawing Sheets

TRIM ANGLE CONTROL DEVICE FOR MARINE PROPULSION MOTORS

BACKGROUND OF THE INVENTION

This invention relates to a trim angle control device for marine propulsion motors and more particularly to an improved arrangement for controlling the trim position of a marine outboard drive and which is responsive to watercraft speed.

It is well known to support a marine outboard drive (either an outboard motor or the outboard drive portion of an inboard/outboard unit) for pivotal movement about a horizontally extending tilt axis. This pivotal movement is employed for permitting the outboard drive to be tilted up out of the water when not in use or, alternatively, for adjustment of the trim position of the outboard drive during operation of the associated watercraft. It is also well known that the optimum trim angle of the outboard drive varies with the running condition of the watercraft. A wide variety of power units are employed for effecting the pivotal movement of the outboard drive to adjust its trim position during running. Many of these devices are purely manual and require the operator's attention to set the trim angle for the various running conditions. Other devices, which are completely automatic, have also been proposed. The manual devices have the disadvantage of requiring the operator's attention so as to set the trim angle and thus divert from his other duties. Automatic systems, on the other hand, tend to cause frequent hunting of the position of the outboard drive and will adjust its position to compensate for transitory conditions. As a result, these devices do not actually provide the optimum trim angle under all conditions, particularly during transition from one condition to another.

In the copending application entitled "Trim Angle Control Device For Marine Propulsion Motors", Ser. No. 877,473, filed June 23, 1986 and invented by me with Takashi Koike and assigned to the assignee of this application, there is disclosed an improved semi-automatic system wherein the operator may selectively cause the outboard drive to be tilted to a desired position merely by selecting an appropriate directional switch and operating a main activating switch. Although that arrangement has the advantages which overcome the disadvantages of the previously proposed manual and automatic systems, it still requires the operator to make two selective settings in order to adjust the trim condition in at least one direction.

It is, therefore, a principal object of this invention to provide an improved device for setting the trim angle of an outboard drive in a semi-automatic manner and in which the operator need not make a number of control settings.

It is a further object of this invention to provide a device for setting the trim angle of an outboard drive that is simple in operation and which does not require great attention from the operator.

It is a still further object of this invention to provide a trim angle control device for a marine propulsion unit that is semi-automatic in operation so that the operator may select a preset trim condition which will automatically be effected when the watercraft reaches a certain speed.

SUMMARY OF THE INVENTION

This invention is adapted to be embodied in a trim control for a marine outboard drive that is supported for pivotal movement about a horizontally extending trim axis and which includes power means for adjusting the trim position of the outboard drive in a trim up direction and in a trim down direction. A controller is movable to a trim up position and a trim down position and control means operatively connect the controller to the power means for actuating the power means in a trim down direction when the controller is moved to its trim down position and in a trim up position when the controller is moved to its trim up position. The control means is effective to discontinue operation of the power means in at least one direction when the outboard drive reaches a preset position. In accordance with the invention, speed responsive means are included for operating the control means for changing the trim condition when the speed passes a certain value.

DETAILED DESCRIPTION OF THE PREFERRED EMBODIMENTS

Figure 1:
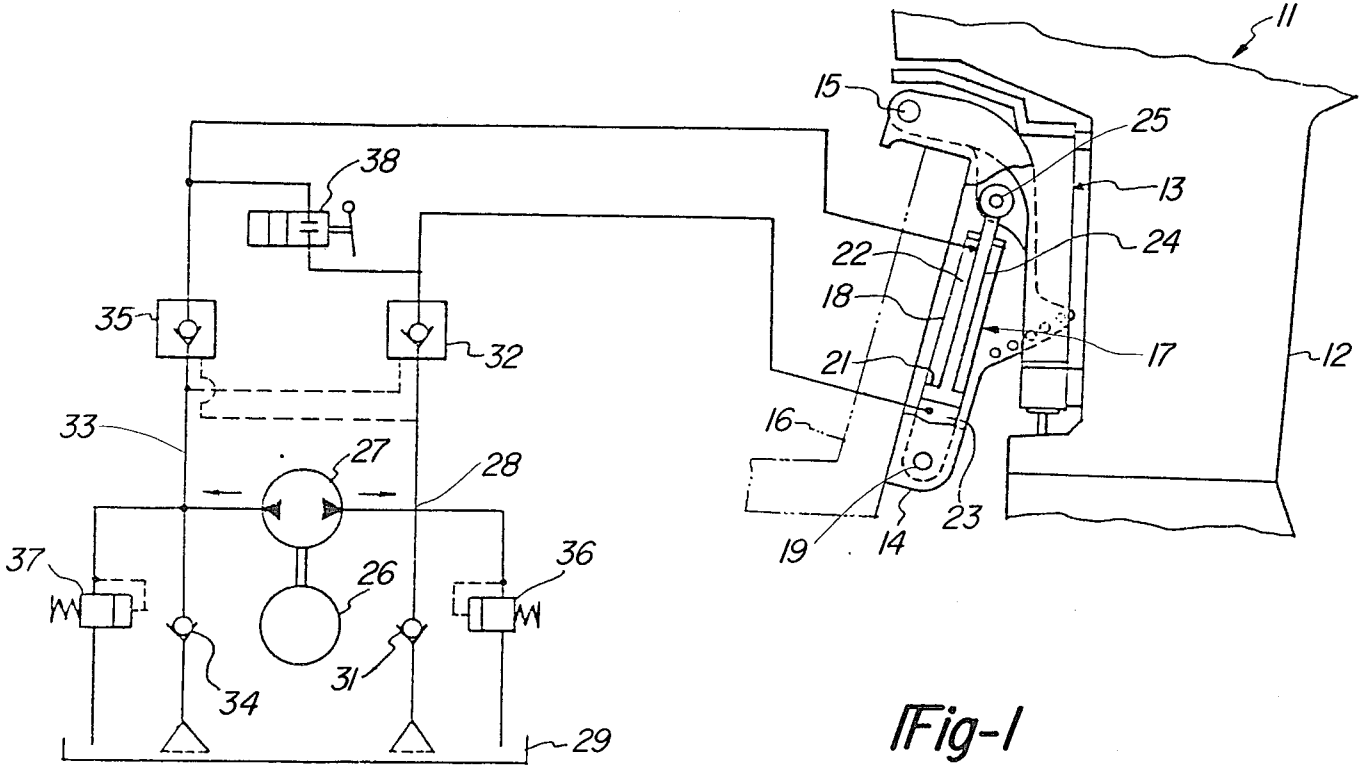
FIG. 1 is a partially schematic side elevational view of a marine outboard drive constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that the invention may equally as well be practiced with the outboard drive unit of an inboard/outboard drive. For that reason, when the term "outboard drive" is used in the specification and claims, it is used generically to describe both types of construction.

The outboard drive includes a drive shaft housing 12 that carries, at its forward end, a steering shaft that is, in turn, journaled within a swivel bracket 13. The swivel bracket 13 is, in turn, affixed to a clamping bracket 14 by means of a tilt pin 15. The tilt pin 15 provides a pivotal connection between the clamping bracket 14 and the swivel bracket 13 for pivotal movement of the outboard drive 11 about a tilt axis defined by the tilt pin 15. The clamping bracket 14 is, in turn, adapted to be affixed to a transom 16 of an associated watercraft in a known manner.

The pivotal movement of the outboard drive 11 about the pivot pin 15 is controlled by means of a fluid motor, indicated generally by the reference numeral 17. The fluid motor 17 includes a cylinder assembly 18 which has a trunnion at its lower end that is pivotally connected by means of a pivot pin 19 to the clamping bracket 14. The cylinder 18 defines an internal bore in which a piston 21 is supported for reciprocation. The piston 21 divides this bore into an upper chamber 22 and a lower chamber 23. The piston 21 has affixed to it a piston rod 24 that is connected by means of a pivot pin 25 to the swivel bracket 13. Accordingly, extension of the piston 21 within the cylinder 18 will cause tilting movement of the outboard drive 11 about the pivot pin 15, as is well known in this art.

A hydraulic circuit, shown schematically in FIG. 1, is provided for pressurizing either the chambers 23 or 22 for effecting the tilting movement of the outboard drive 11. This circuit includes a reversible electric motor 26 that drives a reversible fluid pump 27. The pump 27 has a first port that communicates with a conduit 28 that extends from a reservoir 29 to the lower chamber 23 of the fluid motor. A check valve 31 is positioned in the conduit 28 between the reservoir 29 and the pump port. A pressure operated one-way valve 32 is positioned in the line 28 between the pump port and the fluid motor chamber 23.

In a similar manner, a further conduit 33 extends from the other pump port to the fluid chamber 22. A check valve 34 permits fluid to flow into the conduit 33 from the reservoir 29 and a pressure operated check valve 35 is positioned between this pump port and the chamber 22. A pair of pressure relief valves 36 and 37 are teed off of the lines 28 and 32 for pressure relief.

The hydraulic system operates as follows. If it is desired to tilt the outboard drive 11 up from the position shown in FIG. 1, the motor 26 is operated so that the pump 27 will be driven in a direction to pressurize the line 28 and the line 33 therefore acts as the return line. Fluid under pressure will flow through the line 28 and open the check valve 32 for flow into the chamber 23. At the same time, the check valve 35 will be opened in a known manner by the pressure existent in the line 28 and the line 33 thus acts as a return line so that fluid may be returned from the fluid motor chamber 22 to the inlet side of the pump 27 through the conduit 33. Makeup fluid may be drawn into the conduit 33 through the check valve 34 if required. When the piston 21 reaches the end of its stroke, the pressure will rise in the line 28 and this will be relieved through the relief valve 36 back to the reservoir 29.

It should be readily apparent that tilting down movement is achieved by rotating the motor 26 and pump 27 in the opposite direction so that the line 33 acts as the pressure line and the line 28 acts as the return line.

A manually operated valve 38 is provided between the lines 28 and 33 upstream of the pressure operated check valves 32 and 35. The valve 38 is movable between a closed position, wherein powered tilt and trim is afforded and an opened position wherein the operator may manually tilt the motor 11 up or down without resistance from the fluid system. The hydraulic system as thus far described is conventional and, for that reason, further details are not believed to be necessary. In fact, the invention may be utilized with a wide variety of hydraulic or electrical systems and, for that reason, further details of the hydraulic system are not believed to be necessary to enable those skilled in the art to practice the invention.

Figure 2:
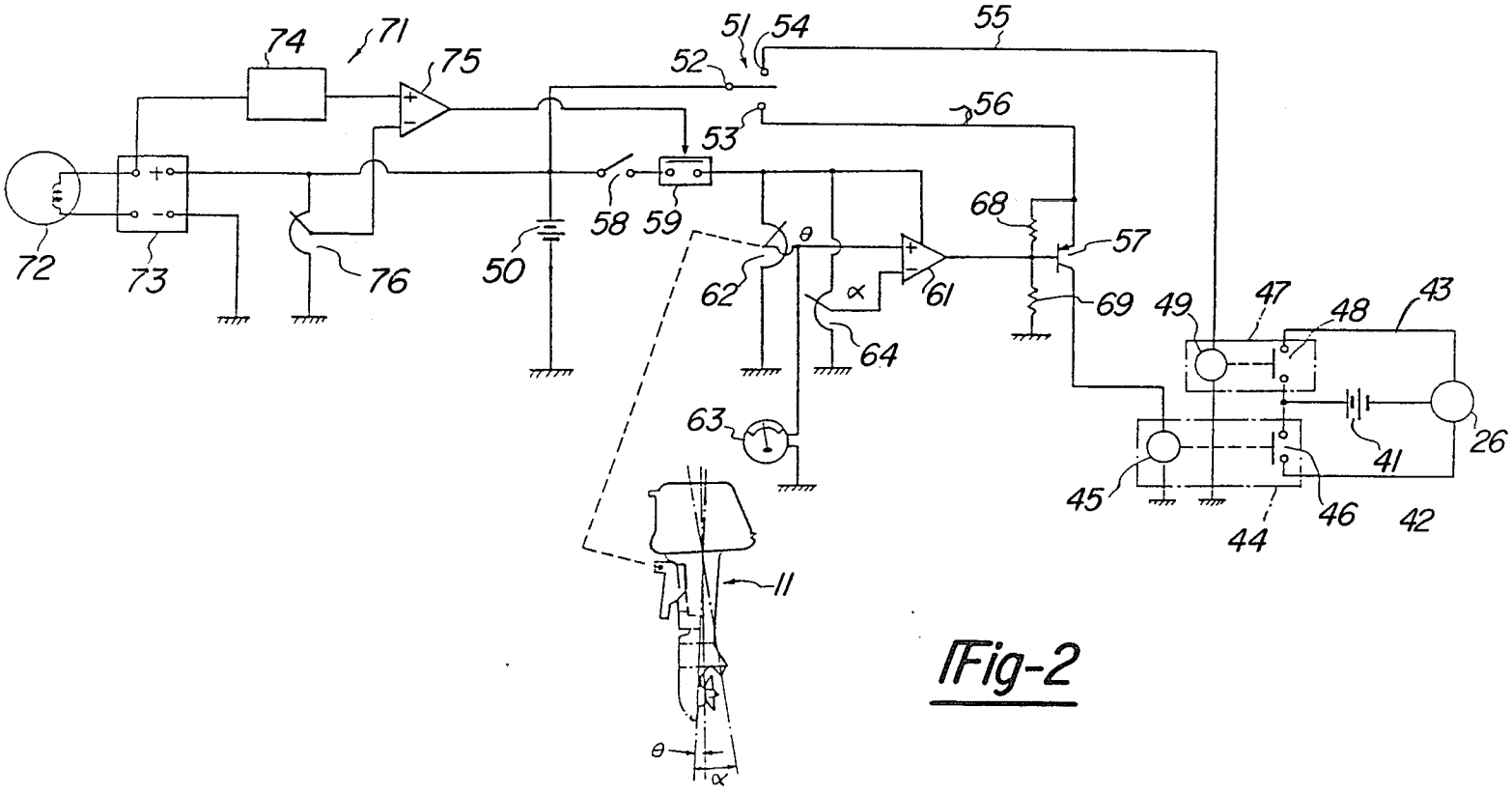
FIG. 2 is a schematic view showing a control circuit constructed in accordance with a first embodiment of the invention.

In accordance with the invention, an arrangement is provided for permitting the operator to selectively activate the motor 26 so as to drive the fluid motor 17 in a direction to adjust the tilt position of the outboard drive 11 between a first position and a second preset position. This mechanism automatically discontinues the operation of the electric motor 26 when this preset position is reached and thus a semi-automatic operation is provided for the tilting of the outboard drive. The device is also speed responsive so that the tilting operation in at least one direction is achieved automatically when the system is energized and a predetermined speed is reached. FIG. 2 shows a first embodiment wherein the operator may selectively activate the outboard drive so as to effect a semi-automatic tilting up operation of the outboard drive. The outboard drive may be tilted down under operator control.

Referring now specifically to this figure, the electric motor 26 is shown as being in circuit with a battery 41. The circuit includes a tilt up circuit 42 and a tilt down circuit 43. Depending on which of the circuits 42 or 43 is energized, the motor 26 will be driven in a direction to effect either tilting up or tilting down of the outboard drive. The tilt up circuit 42 is operated by means of a relay or solenoid operated switch assembly 44 including a solenoid winding 45 and a normally open contact 46 which, when closed, energizes the circuit 42 for driving the motor 26 in the tilt up direction. In a similar manner, a tilt down relay or solenoid controlled switch 47 having a normally open contact 48 and a solenoid winding 49 is provided for selectively closing the circuit 43 and energizing the motor 26 in the tilt down direction.

The control circuit for operating the relay or solenoid operated switches 44 and 47 includes a DC power source 50 that is in circuit with an operator controlled selector switch 51 having a live terminal 52 and an "up" terminal 53 and "down" terminal 54. The selector switch 51 is normally opened. If the operator selects tilt down operation, the live terminal 52 is connected to the down terminal 54 so as to energize a line 55 and deliver electrical power to the solenoid or winding 49 of the relay 47 for closing the switch 48 and driving the motor 26 in a down direction.

The terminal 53 is in contact with a line 56 that connects the terminal 53 to the winding 45 of the relay 44. However, a transistor 57 is provided in this line so that the transistor 57 must be switched on before the winding 45 can be energized. The transistor 57 is controlled by means of a control circuit including a main power switch 58 and a speed responsive switch 59, which are in series with each other. When closed, the switches 58 and 59 energized a comparator 61. The comparator 61 receives a first signal of trim angle of the outboard drive 11 through a trim angle sensing device 62, which may be a variable resistor. Such variable resistors or trim angle sensors are well known in the art and, for that reason, a detailed description of this device is not believed to be necessary. If desired, a trim angle indicator 63 may also be energized by the sensor 62 so as to give the operator an indication of actual trim position of the outboard drive.

The other input of the comparator 61 receives a signal from the trim angle setting device 64 which may be preset by the operator or at the factory to provide the desired trim angle for automatic operation. If the actual trim angle $\theta$ is less than the preset desired trim angle $\alpha$, the comparator 61 will switch the transistor 57 on until the preset angle is reached at which time the comparator 61 will switch the transistor 57 off. A voltage divider circuit comprised of a pair of resistors 68 and 69 are in the circuit for operating the transistor 57.

The operator can manually trim the outboard drive 11 down at any time by closing the live contact 52 to the down terminal 54. The operator can also effect the automatic trimming up of the outboard drive once a preset speed is reached. In order to do this, the outboard drive 11 is trimmed down to the low speed running condition and then the operator closes the switch 58 and moves the switch 51 to the up position so that the live terminal 52 contacts the contact 53. A speed sensing system, indicated generally by the reference numeral 71 is provided for effecting automatic trimming up to the preset angle $\alpha$ when a predetermined speed is reached.

The speed sensing system 71 includes the magneto generator 72 of the outboard drive which delivers its output to a rectifier 73 that may be employed for charging the battery 50. In addition, a speed responsive signal is transmitted from the pulser coil of the magneto generator 72 to a frequency to voltage converter 74 that outputs a voltage signal indicative of engine speed to one terminal of a comparator 75. The other comparator terminal receives a preset speed signal from a variable potentiometer 76 which may be set by the operator so as to determine the speed at which trim up is automatically achieved. When the comparator 75 senses that the speed of the outboard drive 11 reaches the preset speed of the potentiometer 76, the comparator 75 will output a signal that closes the switch 59 and then assuming that the outboard drive 11 is not in the position $\alpha$, the comparator 61 will be energized to switch the transistor 57 on and energize the switch 44 so as to drive the motor 26 in a trim up condition. This trimming up operation will continue until the preset position $\alpha$ is reached at which time the comparator 61 will switch the transistor 57 off and the trim up operation will be discontinued.

Thus, it may be readily apparent that the operator need only precondition the system in order to achieve trim up when the watercraft reaches its preset speed. Therefore, the device offers considerable convenience.

Figure 3:
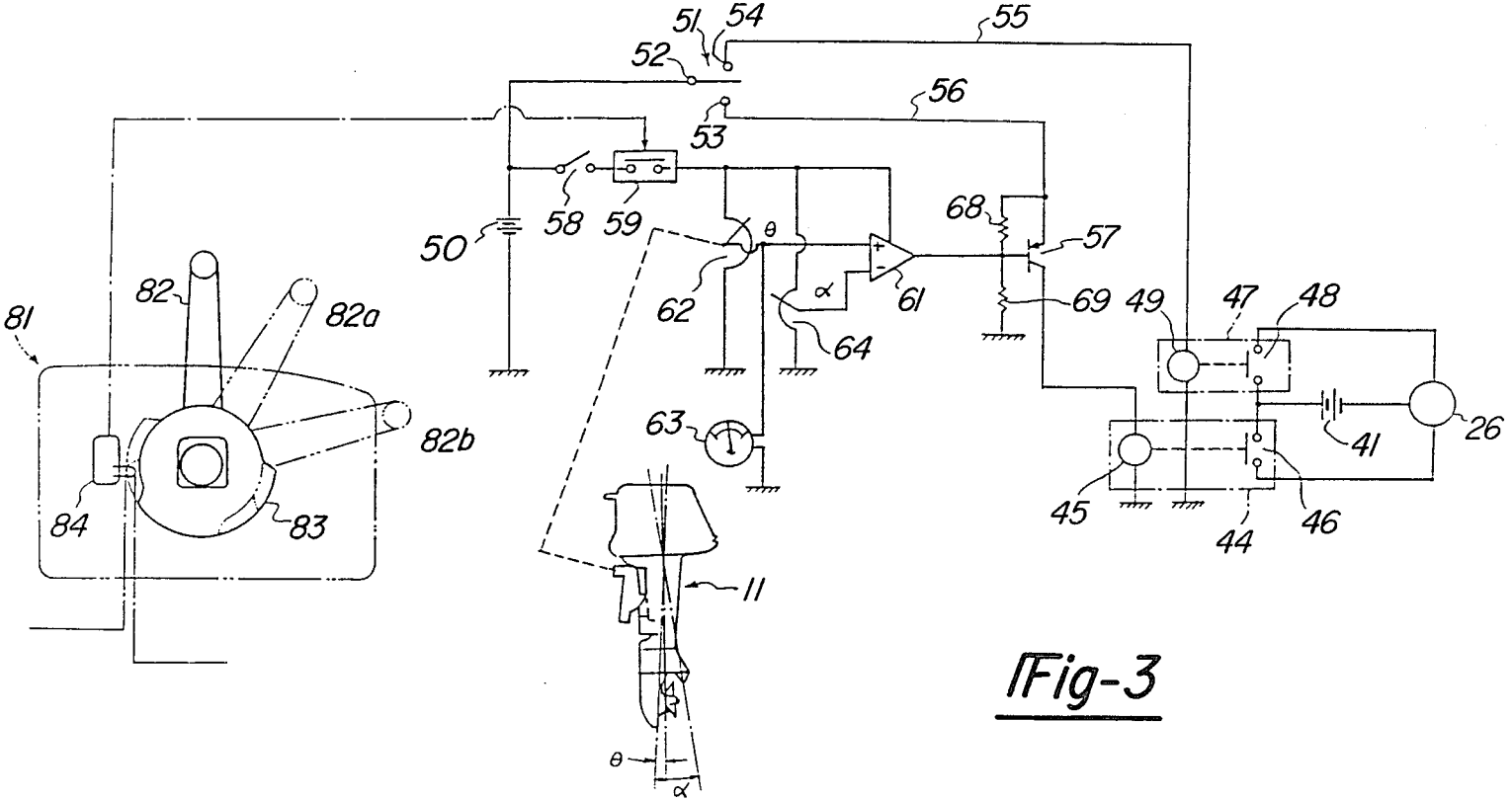
FIG. 3 is a schematic view, in part similar to FIG. 2, showing another embodiment.

In the embodiment of FIG. 2, watercraft speed is sensed by sensing the actual speed of the outboard drive 11. It is to be understood, however, that speed may be sensed in a variety of other manners and FIG. 3 shows another embodiment wherein speed is sensed by throttle control position. In this embodiment, the main circuitry is the same as the embodiment of FIG. 2 and for that reason the components which are the same have been identified by the same reference numeral and their description will not be repeated. In this embodiment, however, the speed responsive switch 59 is controlled by the watercraft throttle and transmission control mechanism, indicated generally by the reference numeral 81. This mechanism includes a lever 82 that is movable from an idle, neutral position, as shown in the solid line view, to a low speed position **82*a* and a high speed position 82*b* with a plurality of intermediate positions. As is well known in this art, the lever 82 also is operative to control the transmission and when the lever 82 is moved to an appropriate position, forward drive will be engaged. In accordance with the invention, a cam 83 is operated by the lever 82 and when the preset high speed condition is reached, the cam 83 contacts a switch 84, which may be the switch 59, or which may operate the switch 59 in an appropriate manner so as to complete the circuit to the comparator 61** and turn it on.

It should be readily apparent from the foregoing description that a number of embodiments of the invention have been illustrated and described each of which permits the operator to automatically effect trim up to a preset position once a predetermined speed is reached without requiring his full attention at all times and without encountering the hunting which occurs with convention automatic systems. Although a number of embodiments of the invention have been illustrated and described, various changes and modifications may be made without departing from the spirit and scope of the invention, as defined by the appended claims.

I claim:

1. In a trim control for a marine outboard drive supported for pivotal movement about a generally horizontally extending trim axis, power means for adjusting the trim position of said outboard drive in a trim up direction and in a trim down direction, a controller movable to a trim up position and a trim down position, control means operatively connecting said controller to said power means for actuating said power means in one of said trim directions only when said controller is moved to its respective trim position and conditioned for movement in the other of said trim directions only when said controller is moved to its other control position, and speed responsive means operable in series with said controller for operating said control means for changing the trim condition of said outboard drive in said other trim direction only when both the speed passes a preset value and when said controller is in its other control position.

2. In a trim control as set forth in claim 1 wherein the speed responsive means effects trimming up of the outboard drive to a preset position when a predetermined speed is exceeded.

3. In a trim control as set forth in claim 2 wherein the reaching of the preset speed is determined by a comparator circuit comparing the preset speed with actual speed.

4. In a trim control as set forth in claim 3 wherein the preset speed is selectively adjustable.

5. In a trim control as set forth in claim 2 wherein the speed is the speed of the outboard drive.

6. In a trim control as set forth in claim 5 wherein the reaching of the preset speed is determined by a comparator circuit comparing the preset speed with actual speed.

7. In a trim control as set forth in claim 6 wherein the preset speed is selectively adjustable.

8. In a trim control as set forth in claim 1 wherein the speed is sensed by sensing throttle position of the powering engine.

9. In a trim control as set forth in claim 1 wherein the reaching of the preset speed is determined by a comparator circuit comparing the preset speed with actual speed.

10. In a trim control as set forth in claim 9 wherein the preset speed is selectively adjustable.

11. In a trim control for a marine outboard drive supported for pivotal movement about a generally horizontally extending trim axis, power means for adjusting the trim position of said outboard drive in a trim up direction and in a trim down direction, a controller movable to a trim up position and a trim down position, and control means operatively connecting said controller to said power means for actuating said power means in a trim up direction when said controller is moved to its trim up position and in a trim down direction when said controller is moved to its trim down position, said control means being effective to discontinue operation of said power means in at least one direction when said outboard drive reaches a preset position, the improvement comprising speed responsive means for operating said control means for changing the trim condition of said outboard drive when the speed passes a preset value, said speed responsive means effecting trimming up of said outboard drive to a preset position when said predetermined speed is exceeded, speed being sensed by sensing throttle position of the powering engine.

* * * * *